US011534809B2

(12) United States Patent
Hassel et al.

(10) Patent No.: US 11,534,809 B2
(45) Date of Patent: Dec. 27, 2022

(54) DEVICE FOR COOLING METAL STRIPS OR SHEETS

(71) Applicant: SMS group GmbH, Düsseldorf (DE)

(72) Inventors: Christoph Hassel, Duisburg (DE); Thomas Heimann, Iserlohn (DE); Heinz-Jürgen Oudehinken, Essen (DE); Henning Berg, Kreuztal (DE); Johannes Alken, Siegen (DE)

(73) Assignee: SMS group GmbH, Düsseldorf (DE)

( * ) Notice: Subject to any disclaimer, the term of this patent is extended or adjusted under 35 U.S.C. 154(b) by 587 days.

(21) Appl. No.: 16/606,420

(22) PCT Filed: Apr. 18, 2018

(86) PCT No.: PCT/EP2018/059896
§ 371 (c)(1),
(2) Date: Oct. 18, 2019

(87) PCT Pub. No.: WO2018/192968
PCT Pub. Date: Oct. 25, 2018

(65) Prior Publication Data

US 2020/0122209 A1 Apr. 23, 2020

(30) Foreign Application Priority Data

Apr. 18, 2017 (DE) ..... 10 2017 206 540.0

(51) Int. Cl.
*B21B 45/02* (2006.01)
*B21B 37/76* (2006.01)
(Continued)

(52) U.S. Cl.
CPC ..... *B21B 45/0218* (2013.01); *B21B 37/76* (2013.01); *C21D 1/60* (2013.01);
(Continued)

(58) Field of Classification Search
CPC . B21B 37/76; B21B 45/0218; B21B 45/0233; C21D 1/60; C21D 1/667;
(Continued)

(56) References Cited

U.S. PATENT DOCUMENTS 4,247,047 A * 1/1981 Schaming ..... B05B 12/04 239/557
5,212,975 A * 5/1993 Ginzburg ..... B21B 27/10 72/236
(Continued)

FOREIGN PATENT DOCUMENTS

CN 101381806 B 4/2012
DE 4009868 A1 10/1991
(Continued)

OTHER PUBLICATIONS

International Search Report with English translation and Written Opinion with machine translation dated Aug. 21, 2018 in corresponding International Application No. PCT/EP2018/059896; 29 pages.
(Continued)

*Primary Examiner* — Jessee R Roe
*Assistant Examiner* — Michael Aboagye
(74) *Attorney, Agent, or Firm* — Maier & Maier, PLLC

(57) ABSTRACT

A device and a method for cooling metal strips or sheets conveyed on a conveyor line, in particular hot-rolled strips in the outlet of a rolling train. For these purposes, the device includes at least one cooling beam extending across the width of the conveyor line, and the cooling beam features a connection point to which a supply tube for cooling liquid can be connected, and a number of discharge openings arranged along a longitudinal axis of the cooling beam, such that cooling liquid can be discharged through the discharge openings in the direction of the metal strip or sheet that is to
(Continued)

be cooled. Associated with each of the individual discharge openings is a respectively adjusted flow area, such that the flow areas of the respective discharge openings decrease in a direction leading away from the connecting point along the longitudinal axis of the cooling beam.

6 Claims, 4 Drawing Sheets

(51) Int. Cl.
*C21D 9/48* (2006.01)
*C21D 11/00* (2006.01)
*C21D 1/667* (2006.01)
*C21D 1/60* (2006.01)

(52) U.S. Cl.
CPC ..... *C21D 1/667* (2013.01); *C21D 9/48* (2013.01); *C21D 11/005* (2013.01)

(58) Field of Classification Search
CPC ... C21D 8/02; C21D 9/46; C21D 9/48; C21D 11/005
USPC ..... 72/342.2, 201, 202; 266/46, 111, 113
See application file for complete search history.

(56) References Cited

U.S. PATENT DOCUMENTS 6,062,056 A * 5/2000 Groch ..... B21B 45/0233 72/201
9,180,504 B2 * 11/2015 Baumgärtel ..... B21B 45/0233
9,539,629 B2 * 1/2017 Seidel ..... B21B 45/0218

FOREIGN PATENT DOCUMENTS

| | | | | | |
|---|---|---|---|---|---|
| DE | 198 54 675 | A1 | | 6/2000 | |
| DE | 10327383 | A1 | | 2/2005 | |
| DE | 102007053523 | A1 | | 12/2008 | |
| DE | 102010049020 | A1 | | 4/2012 | |
| DE | 102014001146 | A1 | | 8/2015 | |
| EP | 0 081 132 | B2 | | 1/1992 | |
| JP | S61-162223 | A | | 7/1986 | |
| JP | S6112223 | | * | 7/1986 | ..... B21B 45/0218 |
| JP | H06-71327 | A | | 3/1994 | |
| JP | H08-155527 | A | | 6/1996 | |
| JP | H08-164410 | A | | 6/1996 | |
| JP | 2010-005683 | A | | 1/2010 | |
| KR | 100825619 | B1 | | 4/2008 | |
| WO | 99/42769 | A1 | | 8/1999 | |
| WO | 2014/170139 | A1 | | 10/2014 | |

OTHER PUBLICATIONS

Written Opinion with machine translation dated Mar. 22, 2019 in corresponding International Application No. PCT/EP2018/059896; 20 pages.
Discussion with machine translation issued on Jun. 17, 2019 in corresponding International Application No. PCT/EP2018/059896; 6 pages.

* cited by examiner

DEVICE FOR COOLING METAL STRIPS OR SHEETS

FIELD

The invention relates to a device for cooling metal strips or sheets conveyed on a conveyor line.

BACKGROUND

When manufacturing steel materials, their mechanical properties may be affected in a variety of ways. By supplementing certain alloying elements, an increased rigidity is reached (solid solution hardening). During rolling, moreover, the temperature of the finishing train may be reduced in order to obtain a higher dislocation density (dislocation hardening). By adding micro-alloy elements such as Nb, V, or Ti, precipitates are formed that lead to an increase in strength (precipitation hardening). However, the aforementioned mechanisms have the disadvantage that they adversely affect the tenacity of the material produced. On the other hand, a fine grain structure of (fine grain hardening) has a positive impact on the strength properties, and simultaneously also on the tenacity properties of the steel materials produced. A small grain size improves the strength and tenacity properties of the steel materials.

The aforementioned addition of alloy and/or micro-alloy elements known in the context of the operation of cast rolling mills and hot-rolling trains has the disadvantage that such an addition is expensive, and is further limited by various framework conditions.

From prior art, it is known about the production of metal strips or sheets that the metal strips or sheets can be cooled by cooling beams that extend across the width of the conveyor line along which the metal strips or sheets are transported. FIG. 4 shows a schematic simplified side view of a conventional cooling beam, in which the geometries of the discharge openings are kept constant across the width B of the conveyor line or along a longitudinal axis of the cooling beam.

When manufacturing steel materials, a reduction of the (ferrite) grain size generally leads to an increase in strength, which is described by the Hall-Petch equation. Accordingly, the increase in strength is inversely proportional to the grain size. By increasing the cooling rate, the grain size of the final product is reduced, such that boosting the cooling makes possible the production of higher-strength materials. For these purposes, it bears pointing out that the tenacity properties of the final product are improved by a finer ferrite grain, which is described by the Cottrell-Petch relationship.

If, in order to reduce the grain size, the amount of water discharged from the cooling beams onto the metal strips or sheets is increased, given a conventional cooling beam according to FIG. 4, this will lead to an uneven flow across the width B of the conveyor line due to fluidic changes in the water flow. An increase of the amount of water leads to an increase of the dynamic pressure on the side opposite of the inflow (in FIG. 4 this is the front face of the cooling beam shown in the left side of the image), thus preventing an unrestricted formation of the spray height in the direction of a surface of the metal strip or sheet. This results in a triangular spray pattern, shown in FIG. 4 in a schematically simplified manner. The height of the water jet adjacent to the discharge openings respectively corresponds here to an amount of discharged cooling liquid. In a direction away from the inflow (or in the direction of the front face of the cooling beam shown in the left side of the image), the discharged amount of cooling liquid therefore increases, which leads to a disadvantageous uneven distribution of temperatures across the width B of the conveyor line.

From DE 40 09 868 A1, a device is known with the features according to general concepts of this technology.

JP H08 164410 A discloses a device for cooling metal strips or sheets, in which a cooling beam is arranged on an upper side of a metal strip, and in which the discharge openings of the cooling beam, formed as little tubes to both front faces of the cooling beam, are fed with cooling liquid by a plurality of supply lines.

SUMMARY

Accordingly, the task of the invention is to optimize the cooling during the manufacturing of metal strips or sheets by way of simple means in order to obtain better mechanical properties of the metallic material.

A device according to the present invention serves for cooling metal strips or sheets that are conveyed on a conveyor line, wherein cooling liquid is discharged through discharge openings of cooling beams arranged opposite from each other respectively on the upper side and the lower side of the metal strip or sheet that is to be cooled, and which respectively extend across the width of the conveyor line in the direction of the metal strip. The cooling liquid is discharged here at a specific rate of 100 to 200 $m^3/(m^2*h)$ onto a surface of the metal strip, such that a distribution of cooling liquid across the width of the conveyor line is parabolic. This parabolic distribution of amounts of cooling liquid across the width of the conveyor line takes into account the fact that for the stated high specific amounts of cooling liquid, there is an additional degree of cooling at the edges of the metal strip that should not be neglected, due to the cooling liquid discharged there. Thus, the parabolic distribution of amounts that provides for a lower amount of cooling liquid at the edges of the conveyor line or of the metal strip as compared to the middle of the conveyor line can effectively prevent an uneven cooling in the form of under-cooling at the edges or sides of the metal strip. For the device according to the invention, it is further provided that a respective adjusted flow area is associated with the individual discharge openings, such that the flow area of a discharge opening adjacent to a front face of the cooling beam positioned opposite of the connection point for the supply tube of the cooling liquid is smaller than the flow area of a discharge opening directly adjacent to this connection point.

The individual discharge openings of a respective cooling beam arranged at the upper side and at the lower side of the metal strip or sheet that is to be cooled have a respective adjusted flow area associated with them, and with it a respective aperture, arranged in the inlet region of the associated discharge openings. The respective arrangement of these apertures in an inlet region of the discharge openings associated with them means that these apertures are arranged upstream from the discharge openings. In this respect, it bears pointing out that the adjusted flow area respectively associated with the individual discharge openings is achieved or defined by an embodiment of the individual apertures. This leads to the advantage that the discharge openings may be formed, for instance by a plurality of tubes with respectively identical cross sections, which leads to cost benefits.

The individual discharge openings are respectively formed as tubes, arranged on an enclosure of the cooling beam. It may be provided that, as explained above, apertures are arranged upstream from the individual tubes, the apertures defining a respectively adjusted flow area for the individual discharge openings.

The previously explained distribution of cooling liquid over an upper and a lower surface of a metal strip leads to an even cooling of the upper or lower side of the metal strip. As the application of cooling liquid to a lower surface of the metal strip is at least 20% higher than on the upper surface of the metal strip, a highest possible evenness for the produced metal strip is set or obtained.

A cooling beam according to the present invention may be installed in multiple cooling groups arranged along a conveyor line for the metal strip. In order to set a uniform distribution of temperatures for the metal strip along the conveyor line, it may be provided according to the invention that cross-sprayers are installed between the individual cooling groups, such that water present on the metal strip may be reliably removed by means of a cross-sprayer. This prevents cooling liquid, preferably water, from running along or entering into a reel, thus preventing an undesired cooling of the metal strip by this water.

By means of the present invention, the cooling rate for a metal strip during its production can be effectively increased, with a uniform distribution of temperatures across its width. This increase of the cooling rate leads to a reduction of the ferrite grain size, which in turn leads to an improvement of the strength properties of the metal strip produced. Accordingly, an application of the present invention and the resulting refinement of the ferrite grains and a resulting increase in strength allows for dispensing with part of the alloying elements that would otherwise be needed in order to increase the strength. As a result it is possible to produce metal strips or steel with the same strength as before, but at a lower cost. This is possible in particular for steel types whose strength is increased through the use of the micro-alloy elements Ti, V, and Nb.

BRIEF DESCRIPTION OF THE FIGURES

In the following, preferred embodiments of the invention are described in detail based on a schematically simplified drawing.

The figures show as follows.

DETAILED DESCRIPTION

Figure 1:
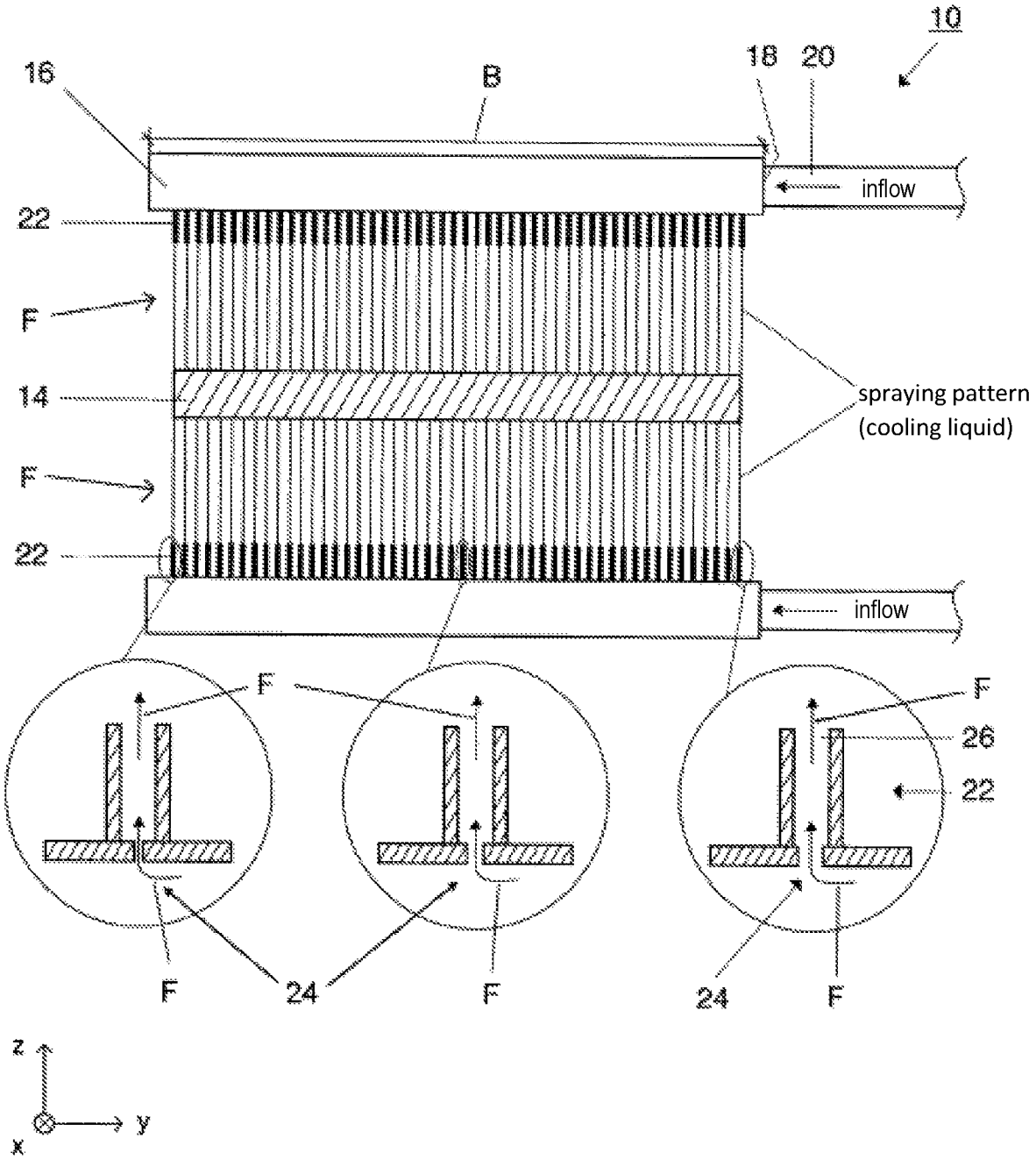
FIG. 1 shows a sectional view along line A-A of FIG. 2 for a device not according to the invention for cooling a metal strip, in which cooling beams are arranged on an upper and on a lower side of the metal strip.

In the following, preferred embodiments of a device 10 according to the invention for cooling a metal strip and respective methods are explained with reference to FIGS. 1 through 3. The device 10 is only shown in a simplified manner in the drawing, and in particular not to scale.

The device 10 serves for cooling a metal strip 14 conveyed on a conveyor line 12. The conveyor line 12 is shown in principal in a simplified manner in a side view in FIG. 2. The conveyor line 12 may be a portion of a finishing train, of which the final station, respectively a rolling station, is marked in FIG. 2 with reference number "1". From this rolling station 1, the metal strip 14 is transported in the direction of a reel 2, which in the illustration of FIG. 2 is therefore from left to right. Multiple so-called reinforced cooling groups VK are arranged along the conveyor line 12, specifically upstream and downstream from multiple conventional cooling groups KK, viewed in a transportation direction T (cf. FIG. 2) of the metal strip 14 along the conveyor line 12. In order to determine a temperature of the metal strip transported on the conveyor line 12, multiple pyrometers 4 are provided adjacent to the cooling groups.

It bears specifically pointing out here that the drawing features a Cartesian coordinate system. The x-axis represents the transportation direction of the metal strip 14 along the conveyor line 12. The y-axis represents a width of the conveyor line 12, or respectively, of the metal strip 14. The z-axis represents a vertical dimension and marks a construction height of the device 10.

Figure 2:
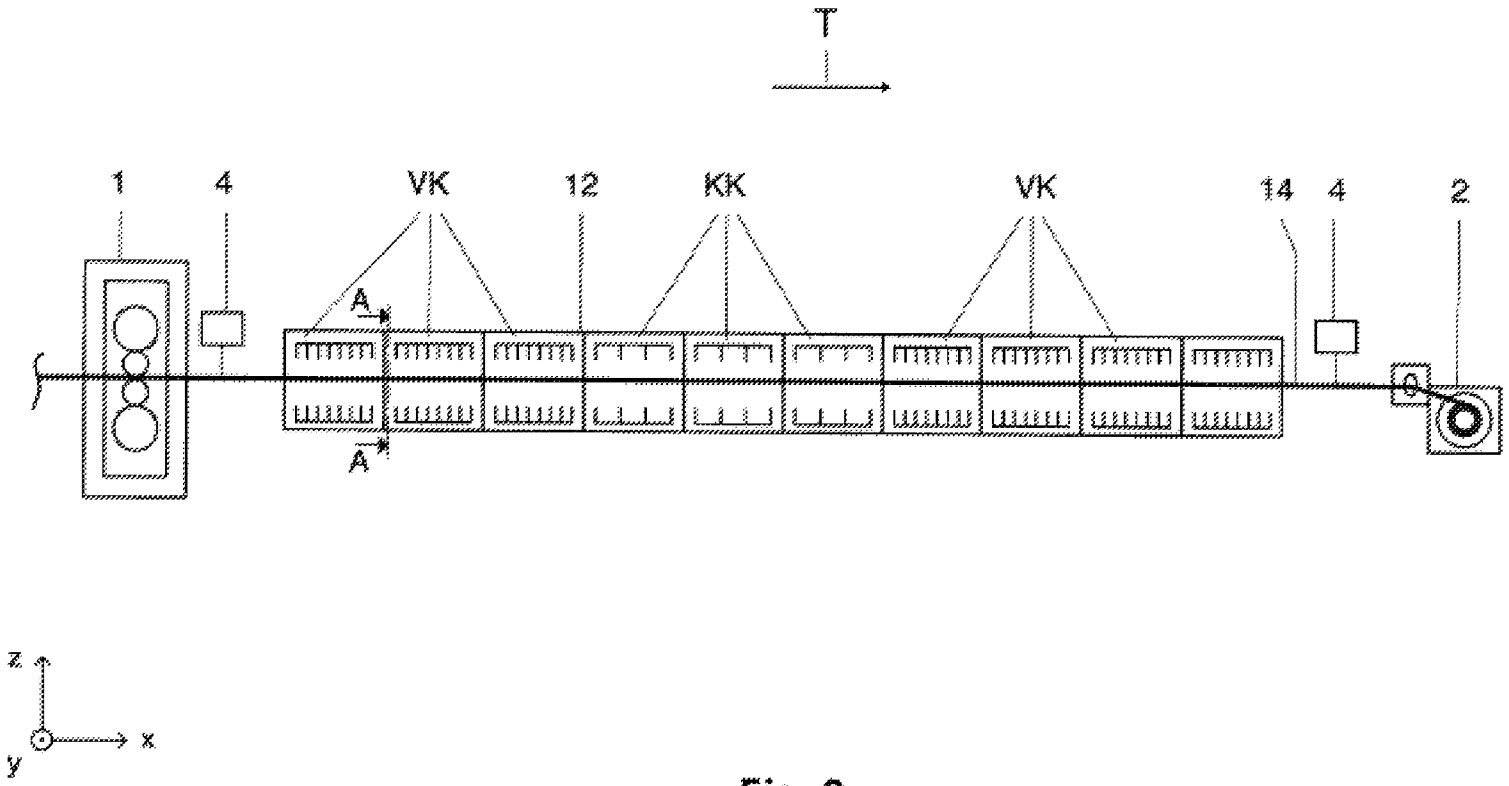
FIG. 2 shows a schematic side view of a conveyor line or finishing train with a final station for producing a metal strip, and subsequent laminar cooling, including a reel system.

FIG. 1 shows a section along line A-A of FIG. 2 and provides a side view of the device 10 that is not according to the invention, which is part of a reinforced cooling group VK. With respect to a longitudinal axis of the metal strip 14, in other words, above and below it, the device 10 is formed symmetrically, such that for purposes of simplifying FIG. 1, only the components of this device 10 that are arranged above the metal strip 14 feature were given reference numbers.

The device 10 comprises cooling beams 16 arranged on an upper side and on a lower side of the metal strip 14. Each of these cooling beams 16 features on a front face a connection point 18, to which a supply tube 20 for cooling liquid can be connected. The cooling beams 16 are supplied by the supply tubes 20 with cooling liquid, which is marked in FIG. 1 by means of the word "inflow" and respective arrows inside the supply tube 20.

Along a longitudinal axis of the cooling beam 16, a plurality of discharge openings 22 are provided in the form of little tubes. These tubes 22 serve the purpose of discharging cooling liquid in the direction of the metal strip 14. The sprayed cooling liquid is symbolized in FIG. 1 in an idealized manner by means of respective perpendicular lines F, which impinge on the metal strip 14 on its upper and lower sides.

Upstream from the respective discharge openings of the cooling beams 16 in the form of the individual tubes 22, apertures 24 are arranged. In FIG. 1, three such apertures 24 are exemplarily are shown in circles in an enlarged and highly simplified view. The cooling liquid flowing through these apertures 24 in the direction of a front outlet 26 of the discharge openings 22 is symbolized respectively by a curved arrow F.

With respect to the apertures 24, it bears pointing out that they each feature different flow areas, which are formed in a successively decreasing manner along a longitudinal axis of the cooling beam 16, specifically in a direction leading away from the connection point 18. A comparison of the apertures 24 that are exemplarily shown in the three circles in FIG. 1 demonstrates that the flow area of these apertures 24 in the drawing plane of FIG. 1 successively decreases from right to left, in other words, that it becomes smaller. Thus, respectively adjusted flow areas are associated with the individual discharge openings 22.

With respect to the cooling beam 16, which in FIG. 1 is arranged on an upper side of the metal strip 14, it should be understood that the flow areas of the apertures 24 are similarly formed in a successively decreasing manner in a direction leading away from the connection point 18, as previously explained.

If relatively large amounts of cooling liquid are discharged from the tubes 22 of the cooling beams 16 onto the metal strip 14—for instance, a specific amount between 40 and 150 $m^3/(m^2*h)$ onto an upper side of the metal strip 14, and a specific amount between 40 and 200 $m^3/(m^2*h)$ onto a lower side of the metal strip 14)—the characteristic decrease of the flow area of the apertures 24 along the longitudinal axis of the cooling beam 16 in a direction leading away from the connection point 18 allows for a desired linearly uniform distribution of the cooling liquid F across the width B of the conveyor line, or respectively, of the metal strip 14. This is illustrated as the spraying pattern of FIG. 1. This results in a uniform temperature profile of the metal strip 14 across its width B, specifically on its upper side as well as on its lower side.

Figure 3:
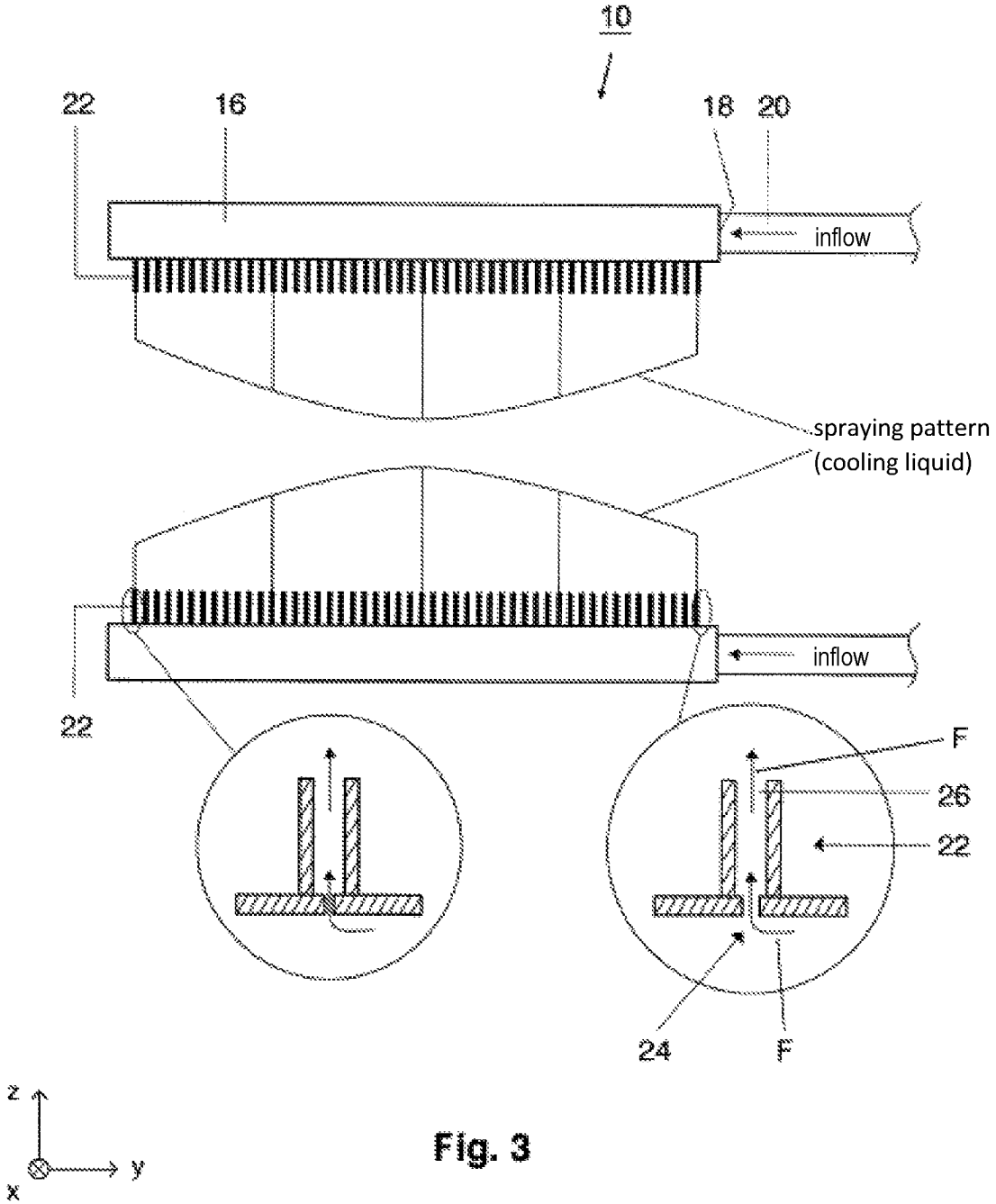
FIG. 3 shows a sectional view along line A-A of FIG. 2 for a device according to the invention according to a further embodiment.
Figure 4:
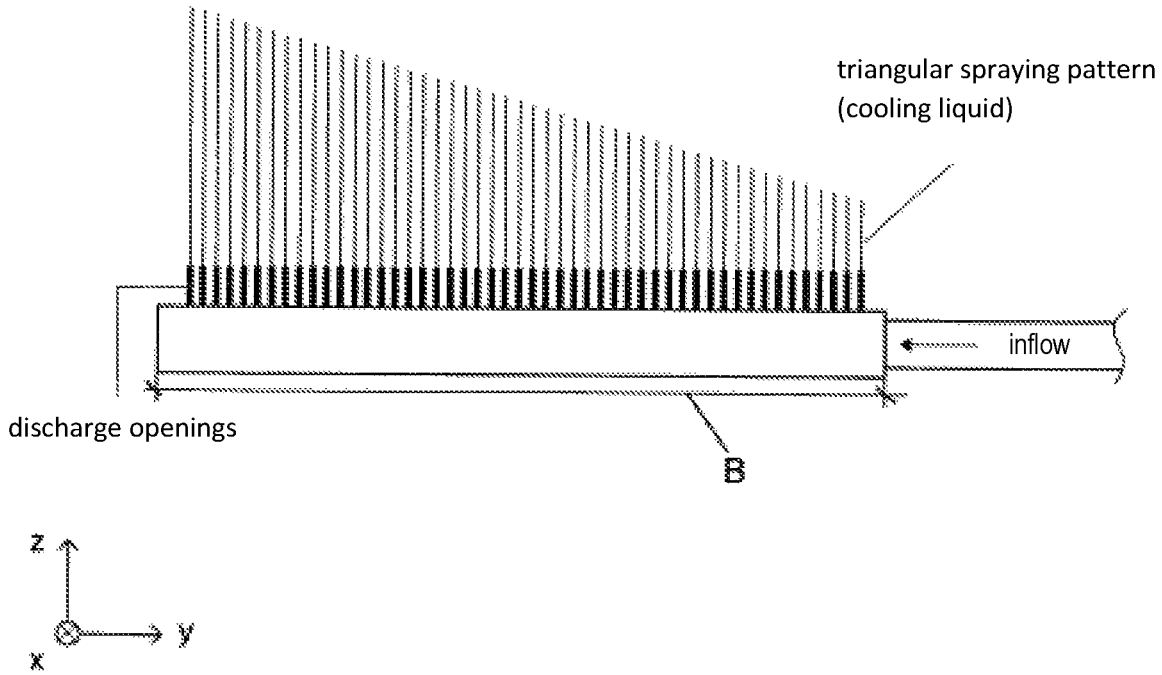
FIG. 4 shows a sectional view of a conventional cooling beam.

FIG. 3 also shows a section along line A-A of FIG. 2, and provides a side view of a device 10 according to the invention. As in FIG. 1, this embodiment of the invention features two facing cooling beams 16, between which a metal strip 14 is transported on or along the conveyor line 14. For purposes of simplification, the metal strip 14 is not shown in the illustration of FIG. 3.

In the embodiment of FIG. 3, the tubes 22 of the cooling beams discharge very large specific amounts of cooling liquid onto upper and lower surfaces of the metal strip 14, for instance at a rate of 100 to 200 $m^3/(m^2*h)$. With such large amounts of water, the discharged cooling liquid provides additional cooling across the edge or side of the metal strip 14 at a not insignificant rate. Accordingly, the flow areas of the apertures 24 arranged upstream from the respective individual discharge openings 22 are selected so as to lead to a parabolic distribution of the cooling liquid across the width B of the conveyor line 12, or respectively, along a longitudinal axis of the cooling beams 16. As in the embodiment of FIG. 1, the flow area of an aperture 24 of a discharge opening 22 adjacent to a front face of the cooling beam 16 opposite of the connection point 18 (at the far left in FIG. 3) is smaller than the flow area of an aperture 24 of a discharge opening 22 immediately adjacent to the connection point 18 (at the far right in FIG. 3). This becomes clear by comparing the two circles of FIG. 3, in which the apertures 24 on the respective front faces of the cooling beam 16 are shown. As explained, this may prevent the disadvantageous formation of a dynamic pressure in the area of the discharge opening 22 immediately adjacent to the connection point 18.

For an implementation of the present invention, it may be provided for the device according to FIG. 1 and/or according to FIG. 3 to be installed along the conveyor line 12 according to FIG. 2 in the so-called reinforced cooling groups, respectively marked as "VK". In such reinforced cooling groups VK, it is possible to increase the cooling rate for a metal strip 14 transported on the conveyor line 12 in the front area and rear areas of the cooling line. The specific supply of the surfaces of the metal strip 14 inside these reinforced cooling groups VK corresponds here with the aforementioned values that were explained for cooling on the upper and lower sides of the metal strip 14. These high specific applications of cooling liquid allowed an increase of the cooling rate by at least 40%, as compared to that in the conventional cooling groups KK. Consequently, it is possible to reduce the temperature of the metal strip 14 at an identical transportation speed in a shorter time, or respectively, along a shorter trajectory, to a predefined temperature, or alternatively, to set a higher transportation speed for the manufacturing of the metal strip 14.

The invention claimed is:

1. A device for cooling metal strips or sheets conveyed on a conveyor line comprising:

cooling beams arranged opposite from each other on a respective upper and lower side of a metal strip or sheet that is to be cooled, and extending across a width of the conveyor line, wherein the cooling beams respectively have, on a front face, a connection point to which a supply tube for cooling liquid is connected;

a plurality of pyrometers is configured to measure temperatures of the metal strip or sheet at a plurality of locations; and a plurality of discharge openings provided along a longitudinal axis of the cooling beam, wherein the cooling liquid is discharged through the discharge openings in a direction of the metal strip or sheet that is to be cooled, individual discharge openings of the plurality of discharge openings are respectively formed as tubes arranged on an enclosure of the cooling beam, a specific amount of the cooling liquid discharged through the plurality of discharge openings of the cooling beam arranged on the upper side of the metal strip or sheet that is to be cooled onto the upper side of the metal strip or sheet is between 100 and 200 $m^3/(m^2*h)$, a specific amount of the cooling liquid discharged through the discharge openings of the cooling beam arranged on the lower side of the metal strip or sheet that is to be cooled onto the lower side of the metal strip or the metal sheet is between 100 and 200 $m^3/(m^2*h)$; and the individual discharge openings have a respective adjusted flow area associated with them, and with it a respective aperture, arranged in an inlet region of associated discharge openings, a flow area of a discharge opening and the associated aperture adjacent to a front face of the cooling beam positioned distal from the connection point is smaller than a flow area of a discharge opening and the associated aperture positioned proximate to the connection point, and the flow areas of the associated apertures are selected such that a distribution of the cooling liquid across the width of the conveyor line is parabolic.

2. The device of claim 1, wherein the metal strip or sheet that is to be cooled are hot-rolled strips in an outlet of a rolling train.

3. The device of claim 1, wherein flow areas of the associated apertures successively decrease along the longitudinal axis of the cooling beam.

4. The device of claim 3, wherein flow areas of the associated apertures successively decrease in a direction leading away from the connection point.

5. The device of claim 1, wherein a plurality of reinforced cooling groups is disposed on both distal and proximal ends of the conveyor line.

6. The device of claim 5, wherein each pyrometer of the plurality of pyrometers is adjacent to a respective reinforced cooling group.

* * * * *